US007375338B1

(12) United States Patent
Hugg et al.

(10) Patent No.: US 7,375,338 B1
(45) Date of Patent: May 20, 2008

(54) SWAPPABLE COLLIMATORS METHOD AND SYSTEM

(75) Inventors: James William Hugg, Glenville, NY (US); Floribertus P. M. Heukensfeldt Jansen, Ballston Lake, NY (US); Jorge Uribe, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/714,970

(22) Filed: Mar. 7, 2007

(51) Int. Cl.
*G21K 1/02* (2006.01)

(52) U.S. Cl. ..... 250/363.1; 250/347

(58) Field of Classification Search ..... 250/363.01, 250/363.02, 363.03, 363.04, 363.05, 363.06, 250/363.07, 363.08, 363.09, 363.1, 347
See application file for complete search history.

(56) References Cited

U.S. PATENT DOCUMENTS

| | | | | |
|---|---|---|---|---|
| 4,289,965 | A | 9/1981 | Koga | |
| 4,389,569 | A | 6/1983 | Hattori | |
| 4,577,107 | A * | 3/1986 | Meeder | 250/363.08 |
| 5,021,667 | A * | 6/1991 | Genna et al. | 250/363.1 |
| 5,032,728 | A | 7/1991 | Chang | |
| 5,059,799 | A * | 10/1991 | Kurakake | 250/363.1 |
| 5,598,003 | A * | 1/1997 | Jones et al. | 250/363.04 |
| 6,285,028 | B1 * | 9/2001 | Yamakawa | 250/370.09 |
| 6,504,157 | B2 | 1/2003 | Juhi | |
| 6,525,320 | B1 | 2/2003 | Juni | |
| 6,525,321 | B2 | 2/2003 | Juni | |
| D474,277 | S | 5/2003 | Juni | |
| D492,998 | S | 7/2004 | Juni | |
| 6,778,637 | B2 * | 8/2004 | Luhta et al. | 378/154 |
| 6,990,176 | B2 * | 1/2006 | Sherman et al. | 378/98.8 |
| 7,012,257 | B2 | 3/2006 | Juni | |
| 7,015,476 | B2 | 3/2006 | Juni | |
| 7,071,473 | B2 | 7/2006 | Juni | |
| 7,105,825 | B2 | 9/2006 | Juni | |
| 7,138,638 | B2 | 11/2006 | Juni | |
| 7,145,153 | B2 * | 12/2006 | Beekman | 250/393 |
| 2004/0239941 | A1 | 12/2004 | Schramm | |

(Continued)

FOREIGN PATENT DOCUMENTS

JP 56101579 A * 8/1981

(Continued)

OTHER PUBLICATIONS

DE Kuhl and RQ Edwards, Cylindrical and Section Radioisotope Scanning of the Liver and Brain, Radiology, 1964, vol. 83, pp. 926-935.

(Continued)

*Primary Examiner*—Kimberly D Nguyen
*Assistant Examiner*—Kiho Kim
(74) *Attorney, Agent, or Firm*—Fletcher Yoder

(57) ABSTRACT

Embodiments include an imaging system that includes a collimator support base and a detector assembly. The collimator support base is configured to interchangeably accept a slit aperture collimator and a pinhole aperture collimator. The slit aperture collimator has either a corresponding septa assembly or a corresponding crossed-slit collimator. The detector assembly is configured to detect collimated gamma rays emanating from a subject in a field of view of the imaging system and generate one or more signals in response to the detected gamma rays. Methods of adjusting performance of imaging systems are also provided.

21 Claims, 9 Drawing Sheets

U.S. PATENT DOCUMENTS

| | | | | |
|---|---|---|---|---|
| 2004/0260171 | A1* | 12/2004 | Graumann | 600/411 |
| 2006/0033028 | A1* | 2/2006 | Juni | 250/363.04 |
| 2006/0050845 | A1 | 3/2006 | Juni | |
| 2006/0182223 | A1* | 8/2006 | Heuscher | 378/137 |
| 2006/0192308 | A1 | 8/2006 | Juni | |
| 2006/0251215 | A1* | 11/2006 | Cernik | 378/71 |
| 2007/0007455 | A1 | 1/2007 | Juni | |
| 2007/0140420 | A1* | 6/2007 | Radley et al. | 378/45 |

FOREIGN PATENT DOCUMENTS

| | | | |
|---|---|---|---|
| JP | 58169076 | A * | 10/1983 |
| WO | WO 00/062093 | | 10/2000 |
| WO | WO 2004/072679 | | 8/2004 |
| WO | WO 2005/006977 | | 1/2005 |
| WO | WO 2005/052634 | | 6/2005 |
| WO | WO 2006/029163 | | 3/2006 |
| WO | WO 2006/050845 | | 3/2006 |
| WO | WO 2006/065441 | | 6/2006 |

OTHER PUBLICATIONS

DE Kuhl, RQ Edwards and AR Ricci, The Mark III Scanner: A Compact Device for Multiple-View and Section Scanning of the Brain, Radiology, 1970, vol. 96, pp. 563-570.

DE Kuhl, RQ Edwards, AR Ricci, RJ Yacob, TJ Mich and A Alavi, The Mark IV System for Radionuclide Computed Tomography of the Brain, Radiology, 1976, vol. 121, pp. 405-413.

GF Knoll and JJ Williams, Application of a Ring Pseudorandom Aperture for Transverse Section Tomography, IEEE Transactions on Nuclear Science, 1977, vol. NS-24, pp. 581-586.

JJ Williams, WP Snapp and GF Knoll, Introducing SPRINT: A single Photon Ring System for Emission Tomography, IEEE Transactions on Nuclear Science, 1979, vol. NS-26, pp. 628-633.

M Tanaka, Y Hirose, K Koga and H Hattori, Engineering Aspects of a Hybrid Emission Computed Tomograph, IEEE Transactions on Nuclear Science, 1981, vol. NS-28, pp. 137-141.

WL Rogers, NH Clinthorne, J Stamos, KF Koral, R Mayans, JW Keyes, Jr., JJ Williams, WP Snapp and GF Knoll, SPRINT: A Stationary Detector Single Photon Ring Tomograph for Brain Imaging, IEEE Transactions on Medical Imaging, 1982, vol. MI-1, pp. 63-68.

Y Hirose, Y Ikeda, Y Higashi, K Koga, H. Hattori, I Kanno, Y Miura, S Miura and K Uemura, A Hybrid Emission CT, IEEE Transactions on Nuclear Science, 1982, vol. NS-29, pp. 520, 523.

GF Knoll, Single-Photon Emission Computed Tomography, IEEE Proc., 1983, vol. 71, pp. 320-332.

WL Rogers, NH Clinthorne, J Stamos, KF Koral, R Mayans, GF Knoll J Juni, JW Keyes, Jr. and BA Harkness, Performance Evaluation of SPRINT, A Single Photon Ring Tomograph for Brain Imaging, J. Nucl. Med., 1984, vol. 25, pp. 1013-1018.

WL Rogers, NH Clinthorne, L. Shao, P Chiao, Y Ding, JA Stamos and KF Koral, Sprint II: A Second Generation Single Photon Ring Tomograph, IEEE Transactions on Medical Imaging, 1988, vol. 7, pp. 291-297.

GL Zeng, Q Huang, Q Tang and WJ Wright, Skew-Slit Collimator for Small Animal SPECT, Society of Nuclear Medicine, Jun. 7, 2006, Oral Presentation, Abstract #664.

JW Hugg, E Asme, J Uribe, FP Jansen, RM Manjeshwar, H Lai, JC Paing, JR Dubois and X Guo, A Small-Animal SPECT/CT System for Dynamic Preclinical Imaging, Dynamic Nuclear Medicine Workshop: Oral Presentation, Abstract Banff International Research Station, Mar. 28, 2006.

JW Hugg, FP Jansen, J Uribe, RM Manjeshwar, H Lai, JC Pang and X Guo, A Small Animal SPECT/CT System with a Stationary CZT Detector Ring and Rotating Multiple Slit or Pinhole Collimator, Orai Presentation, Abstract M13-4, IEEE Medical Imaging Conference, San Diego, Nov. 4, 2006.

JW Hugg, FP Jansen, J Uribe, RM Manjeshwar, H. Lai, JC Pang and X Guo, Design of a Small-Animal SPECT System with a Stationary CZT Detector Ring, Oral Presentation, Abstract MR01-4, IEEE/Room Temperature Semiconductor Detector Conference, San Diego, Nov. 1, 2006.

JW Hugg, FP Jansen, J Uribe and RM Manjeshwar, Design of Multi-Slit and Multi-Pinhole Collimators for a Small-Animal SPECT System with a Stationary CZT Detector Ring, Poster Abstract M06-26, IEEE Medical Imaging Conference, San Diego, Nov. 2, 2006.

J Hugg, J Uribe, F Jansen, R Manjeshwar, H Lai, J Pang, J Dubois and X Guo, Small-Animal SPECT/CT Pre-Clinical Imaging System, Poster Abstract 168, Academy of Molecular Imaging Orlando, Mar. 25, 2006.

JW Hugg, J Uribe, FP Jansen, RM Manjeshwar, H Lai, JC Pang, JR Dubois and X Guo, A Small-Animal MicroSPECT/MicroCT System with a Stationary CZT Detector Ring and Rotating Multi-Pinhole and Multi-Slit Collimators, Oral Presentation, Abstract 663, Society of Nuclear Medicine, San Diego, Jun. 7, 2006.

JW Hugg, FP Jansen, J Uribe, RM Manjeshwar, JC Pang, H Lai and X Guo, A Small-Animal SPECT/CT System with a Stationary CZT Detector Ring for Dynamic Preclinical Imaging, Poster Abstract 782, Society of Molecular Imaging, Honolulu, Sep. 2, 2006.

JW Hugg, J Uribe, FP Jansen, RM Manjeshwar, H Lai, JC Pang, JR Dubois and X Guo, A Small Animal SPECT/CT System with a Stationary CZT Detector Ring and Rotating Multi-Pinhole and Multi-Slit Collimators, Oral Presentation and Abstract, Workshop on Small-Animal SPECT, University of Arizona, Tucson, Mar. 9, 2006.

* cited by examiner

SWAPPABLE COLLIMATORS METHOD AND SYSTEM

BACKGROUND OF THE INVENTION

The invention relates generally to non-invasive imaging such as single photon emission computed tomography (SPECT) imaging. More particularly, the invention relates to swappable collimators for use in non-invasive imaging.

SPECT is used for a wide variety of imaging applications, such as medical imaging. In general, SPECT systems are imaging systems that are configured to generate an image based upon the impact of photons (generated by a nuclear decay event) against a gamma-ray detector. In medical and research contexts, these detected photons may be processed to formulate an image of organs or tissues beneath the skin.

To produce an image, one or more detector assemblies may be rotated around a subject. Detector assemblies are typically comprised of various structures working together to receive and process the incoming photons. For instance, the detector assembly may utilize a scintillator assembly (e.g., large sodium iodide scintillator plates) to convert the photons into light for detection by an optical sensor. This scintillator assembly may be coupled by a light guide to multiple photomultiplier tubes (PMTs) or other light sensors that convert the light from the scintillator assembly into an electric signal. In addition to the scintillator assembly-PMT combination, pixilated solid-state direct conversion detectors (e.g., CZT) may also be used to generate electric signals from the impact of the photons. This electric signal can be easily transferred, converted and processed by electronic modules in a data acquisition module to facilitate viewing and manipulation by clinicians.

Typically, SPECT systems further include a collimator assembly that may be attached to the front of the gamma-ray detector. In general, the collimator assembly is designed to absorb photons such that only photons traveling in certain directions impact the detector assembly. For example, multi-hole collimators comprised of multiple, small-diameter channels separated by lead septa have been used. With these multi-hole collimators, photons that are not traveling through the channels in a direction generally parallel to the lead septa are absorbed. In addition, while parallel-hole collimators are typically used, collimators also may have converging holes for image magnification or diverging holes for minifying the image. For improved resolution, a pinhole aperture collimator may be used. Pinhole aperture collimators are generally collimators with one or more small pinhole apertures therein. By way of example, an improved image resolution may be obtained with a pinhole aperture collimator, e.g., if the subject is closer to the pinhole than the pinhole is to the gamma-ray detector.

SPECT systems may be used for a variety of different applications each of which may require different resolutions and sensitivities. By way of example, small organ imaging may require higher resolution and lower sensitivity, whereas imaging a large volume (such as for possible lesions) typically may require higher sensitivity with lower resolution. Accordingly, it would be desirable to provide an imaging system with adjustable performance based, for example, on the particular application.

BRIEF DESCRIPTION OF THE INVENTION

In accordance with one embodiment, the present technique provides a method of adjusting performance of an imaging system. The method includes removing a slit aperture collimator from the imaging system. The imaging system includes the slit aperture collimator, at least one of a crossed-slit collimator on a side of the slit aperture collimator or a septa assembly having one or more septa spaced on a side of the slit aperture collimator, and a detector assembly. The detector assembly is configured to detect collimated gamma rays emanating from a subject in a field of view of the imaging system. The method further includes removing either the crossed-slit collimator or the septa assembly from the imaging system. The method further includes inserting a pinhole aperture collimator into the imaging system.

In accordance with another embodiment, the present technique provides another method of adjusting performance of an imaging system. The method includes removing a pinhole aperture collimator from the imaging system. The imaging system includes the pinhole aperture collimator and a detector assembly. The detector assembly is configured to detect collimated gamma rays emanating from a subject in a field of view of the imaging system. The method further includes inserting a slit aperture collimator into the imaging system. The method further includes inserting a septa assembly or a crossed-slit collimator into the imaging system.

In accordance with another embodiment, the present technique provides an imaging system including a collimator support base and a detector assembly. The collimator support base is configured to interchangeably accept a slit aperture collimator and a pinhole aperture collimator. The slit aperture collimator has either a corresponding septa assembly or a corresponding crossed-slit collimator. The detector assembly is configured to detect collimated gamma rays emanating from a subject in a field of view of the imaging system and generate one or more signals in response to the detected gamma rays.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
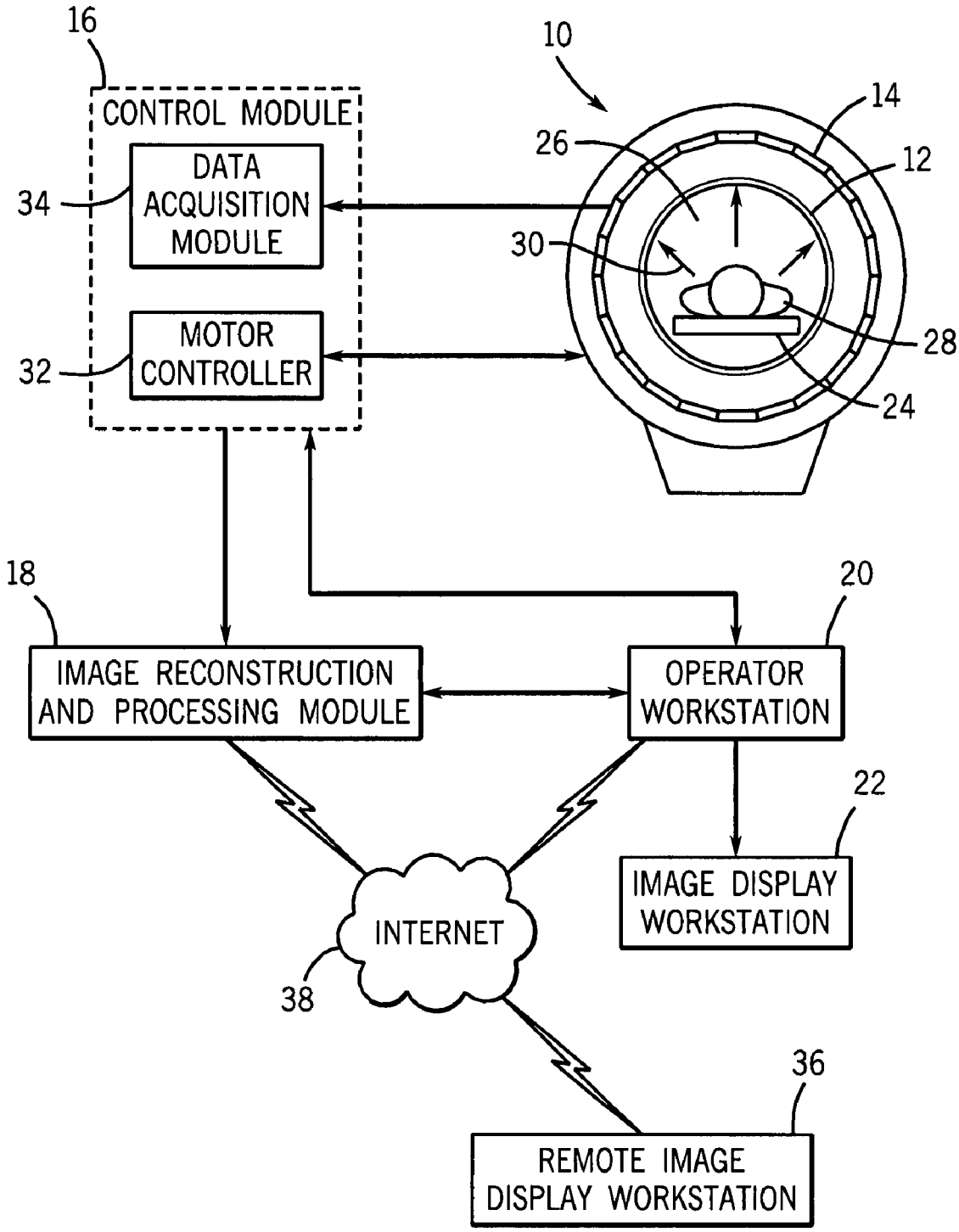
FIG. 1 illustrates a diagram of an exemplary SPECT system which may include a collimator assembly in accordance with embodiments of the present technique.

FIG. 1 illustrates an exemplary SPECT system 10 for acquiring and processing image data in accordance with exemplary embodiments of the present technique. In the illustrated embodiment, SPECT system 10 includes a collimator assembly 12 and a detector assembly 14. The SPECT system 10 also includes a control module 16, an image reconstruction and processing module 18, an operator workstation 20, and an image display workstation 22. Each of the aforementioned components will be discussed in greater detail in the sections that follow.

As illustrated, a subject support 24 (e.g. a table) may be moved into position in a field of view 26 of the SPECT system 10. In the illustrated embodiment, the subject support 24 is configured to support a subject 28 (e.g., a human patient, a small animal, a plant, a porous object, etc.) in position for scanning. Alternatively, the subject support 24 may be stationary, while the SPECT system 10 may be moved into position around the subject 28 for scanning. Those of ordinary skill in the art will appreciate that the subject 28 may be supported in any suitable position for scanning. By way of example, the subject 28 may be supported in the field of view 26 in a generally vertical position, a generally horizontal position, or any other suitable position (e.g., inclined) for the desired scan. In SPECT imaging, the subject 28 is typically injected with a solution that contains a radioactive tracer. The solution is distributed and absorbed throughout the subject 28 in different degrees, depending on the tracer employed and, in the case of living subjects, the functioning of the organs and tissues. The radioactive tracer emits electromagnetic rays 30 (e.g., photons or gamma quanta) known as "gamma rays" during a nuclear decay event.

As previously mentioned, the SPECT system 10 includes the collimator assembly 12 that receives the gamma rays 30 emanating from the field of view 26. The collimator assembly 12 is generally configured to limit and define the direction and angular divergence of the gamma rays 30. In general, the collimator assembly 12 is disposed between the detector assembly 14 and the field of view 26. As will be discussed in more detail below, the collimator assembly 12 may be configured to interchangeably accept a slit aperture collimator and a pinhole aperture collimator so that the performance of the SPECT system 10 may be modified. As will be appreciated by those of ordinary skill in the art, the slit aperture collimator may have a corresponding septa assembly or a corresponding crossed-slit collimator while the pinhole aperture collimator generally may not have a corresponding septa assembly. Accordingly, the collimator assembly 12 generally may contain slit apertures or pinholes apertures therethrough such that gamma rays 30 aligned with either the slit or pinhole apertures pass through the collimator assembly 12. Moreover, the collimator assembly 12 may contain a radiation absorbent material, such as lead or tungsten, for example, so that gamma rays 30 that are not aligned with the slit or pinhole apertures should be at least substantially, if not completely, absorbed by the collimator assembly 12. Referring again to FIG. 1, the collimator assembly 12 extends at least partially around the field of view 26. In exemplary embodiments, the collimator assembly 12 may extend up to about 360° around the field of view 26. By way of example, the collimator assembly 12 may extend from about 180° to about 360° around the field of view 26.

The gamma rays 30 that pass through the collimator assembly 12 impact the detector assembly 14. Due to the collimation of the gamma rays 30 by the collimator assembly 12, the detection of the gamma rays 30 may be used to determine the line of response along which each of the gamma rays 30 traveled before impacting the detector assembly 14, allowing localization of each gamma ray's origin to that line. In general, the detector assembly 14 may includes a plurality of detector elements configured to detect the gamma rays 30 emanating from the subject 28 in the field of view 26 and passing through one or more apertures defined by the collimator assembly 12. In exemplary embodiments, each of the plurality of detector elements in the detector assembly 14 produces an electrical signal in response to the impact of the gamma rays 30.

As will be appreciated by those of ordinary skill in the art, the detector elements of the detector assembly 14 may include any of a variety of suitable materials and/or circuits for detecting the impact of the gamma rays 30. By way of example, the detector elements may include a plurality of solid-state detector elements, which may be provided as one-dimensional or two-dimensional arrays. In another embodiment, the detector elements of the detector assembly 14 may include a scintillation assembly and PMTs or other light sensors.

Moreover, the detector elements may be arranged in the detector assembly 14 in any suitable manner. By way of example, the detector assembly 14 may extend at least partially around the field of view 26. In certain embodiments, the detector assembly 14 may include modular detector elements arranged around the field of view 26. Alternatively, the detector assembly 14 may be arranged in a ring that may extend up to about 360° around the field of view 26. In certain exemplary embodiments, the detector assembly 14 may extend from about 180° to about 360° around the field of view 26. The ring of detector elements may include flat panels or curved detector surfaces (e.g., a NaI annulus). In one exemplary embodiment, the ring may comprise in the range from 9-10 solid-state detector panels with each detector panel comprising four detector modules. Those of ordinary skill in the art will appreciate that the ring need not be circular, for example, the detector elements may be arranged in an elliptical ring or be contoured to the body profile of the subject 28. In addition, in certain exemplary embodiments, the detector assembly 14 may be gimbaled on its support base, e.g., so that arbitrary slice angles may be acquired.

To acquire multiple lines of response emanating from the subject 28 in the field of view 26 during a scan, the collimator assembly 12 may be configured to rotate about the subject 28 positioned within the field of view 26. In accordance with exemplary embodiments, the collimator assembly 12 may be configured to rotate with respect to the detector assembly 14. By way of example, the detector assembly 14 may be stationary while the collimator assembly 12 may be configured to rotate about the field of view 26. Alternatively, the detector assembly 14 may rotate while the collimator assembly 12 is stationary. In certain exemplary embodiments, the collimator assembly 12 and the detector assembly 14 may both be configured to rotate, either together or independently of one another. Alternatively, if sufficient pinhole apertures and/or slit apertures are provided through the collimator assembly 12, then no rotation may be required. Also, if the slit apertures are orthogonal to the longitudinal axis of the collimator assembly 12 (as illustrated below with respect to FIG. 4), then no rotation may be required.

SPECT system 10 further includes a control module 16. In the illustrated embodiment, the control module 16 includes a motor controller 32 and a data acquisition module 34. In general, the motor controller 32 may control the rotational speed and position of the collimator assembly 12, the detector assembly 14, and/or the position of the subject support 26. The data acquisition module 34 may be configured to obtain the signals generated in response to the impact of the gamma rays 30 with the detector assembly 14. For example, the data acquisition module 34 may receive sampled electrical signals from the detector assembly 14 and convert the data to digital signals for subsequent processing by the image reconstruction and processing module 18.

Those of ordinary skill in the art will appreciate that any suitable technique for data acquisition may be used with the SPECT system 10. By way of example, the data needed for image reconstruction may be acquired in a list or a frame mode. In one exemplary embodiment of the present technique, gamma ray events (e.g., the impact of gamma rays 30 on the detector assembly 14), gantry motion (e.g., collimator assembly 12 motion and subject support 24 position), and physiological signals (e.g., heart beat and respiration) may be acquired in a list mode. For example, a time-stamp may be associated with each gamma ray event (e.g., energy and position) or by interspersing regular time stamps (e.g., every 1 ms) into the list of gamma ray events. The physiological signals may be included in the list, for example, when they change by a defined amount or with every regular time stamp. In addition, gantry motion may also be included in the event lists, for example, when it changes by a defined amount or with every regular time stamp. The list mode data may be binned by time, gantry motion or physiological gates before reconstruction. List mode may be suitable in exemplary embodiments where the count rate is relatively low and many pixels record no counts at each gantry position or physiological gate.

Alternatively, frames and physiological gates may be acquired by moving the gantry in a step-and-shoot manner and storing the number of events in each pixel during each frame time and heart or respiration cycle phase. Frame mode may be suitable, for example, where the count rate is relatively high and most pixels are recording counts at each gantry position or physiological gate.

In the illustrated embodiment, the image reconstruction and processing module 18 is coupled to the data acquisition module 34. The signals acquired by the data acquisition module 34 are provided to the image reconstruction and processing module 18 for image reconstruction. The image reconstruction and processing module 34 may include electronic circuitry to provide the drive signals, electronic circuitry to receive acquired signals, and electronic circuitry to condition the acquired signals. Further, the image reconstruction and processing module 34 may include processing to coordinate functions of the SPECT system 10, to implement reconstruction algorithms suitable for reconstruction of the acquired signals. The image reconstruction and processing module 34 may include a digital signal process, memory, a central processing unit (CPU) or the like, for processing the acquired signals. As will be appreciated, the processing may include the use of one or more computers within the image reconstruction and processing module 34. The addition of a separate CPU may provide additional functions for image reconstruction, including, but not limited to, signal processing of data received, and transmission of data to the operator workstation 20 and image display workstation 22. In one embodiment, the CPU may be confined within the image reconstruction and processing module 34, while in another embodiment a CPU may include a stand-alone device that is separate from the image reconstruction and processing module 34.

The reconstructed image may be provided to the operator workstation 20. The operator workstation 20 may be utilized by a system operator to provide control instructions to some or all of the described components and for configuring the various operating parameters that aid in data acquisition and image generation. An image display workstation 22 coupled to the operator workstation 20 may be utilized to observe the reconstructed image. It should be further noted that the operator workstation 20 and the image display workstation 22 may be coupled to other output devices, which may include printers and standard or special purpose computer monitors. In general, displays, printers, workstations, and similar devices supplied with the SPECT system 10 may be local to the data acquisition components, or may be remote from these components, such as elsewhere within the institution or hospital, or in an entirely different location, linked to the image acquisition system via one or more configurable networks, such as the Internet, virtual private networks, and so forth. By way of example, the operator workstation 20 and/or the image reconstruction and processing module 18 may be coupled to a remote image display workstation 36 via a network (represented on FIG. 1 as Internet 38).

Furthermore, those of ordinary skill in the art will appreciate that any suitable technique for image reconstruction may be used with the SPECT system 10. In one exemplary embodiment, iterative reconstruction (e.g., ordered subsets expectation maximization, OSEM) may be used. Iterative reconstruction may be suitable for certain implementations of the SPECT system 10 due, for example, to its speed and the ability to tradeoff reconstruction resolution and noise by varying the convergence and number of iterations.

While in the illustrated embodiment, the control module 16 (including the data acquisition module 34 and the motor controller 32) and the image reconstruction and processing module 18 are shown as being outside the detector assembly 14 and the operator workstation 20. In certain other implementations, some or all of these components may be provided as part of the detector assembly 14, the operator workstation 20 and/or other components of the SPECT system 10.

Those of ordinary skill in the art will appreciate that the performance of the SPECT system 10 is at least partially based on the collimator assembly 12 selected for use therewith. For example, pinhole aperture collimators may be used, in certain embodiments, for small field of view imaging. In certain embodiments, when using a pinhole aperture collimator multiple images may be formed with the subject at different positions within the field of view to form a composite whole-body image. However, this technique generally requires more time to acquire than a whole-body image obtained with a slit aperture collimator. Furthermore, the slit and pinhole apertures collimators typically have different spatial resolutions and sensitivities. Different applications, however, may benefit from operating with different resolutions and sensitivities. By way of example, small organ imaging may require higher resolution and lower sensitivity, whereas imaging a large volume (such as for possible lesions) typically may require higher sensitivity with lower resolution. To provide different resolutions and sensitivities, multiple collimator assemblies may be provided for each SPECT system with each collimator assembly having a different performance point.

An embodiment of the present technique provides for the exchange of collimator assemblies in the SPECT system 10. More particularly, an embodiment of the present technique provides for a SPECT system 10 configured to interchangeably accept a slit aperture collimator with a corresponding septa assembly or a corresponding crossed-slit aperture collimator and a pinhole aperture collimator. In general, the pinhole aperture collimator is not used with a corresponding septa assembly or crossed-slit aperture collimator, although there may be special circumstances in which one wishes to impose a two-dimensional slice restriction on the three-dimensional character of the pinhole aperture collimator.

Figure 2:
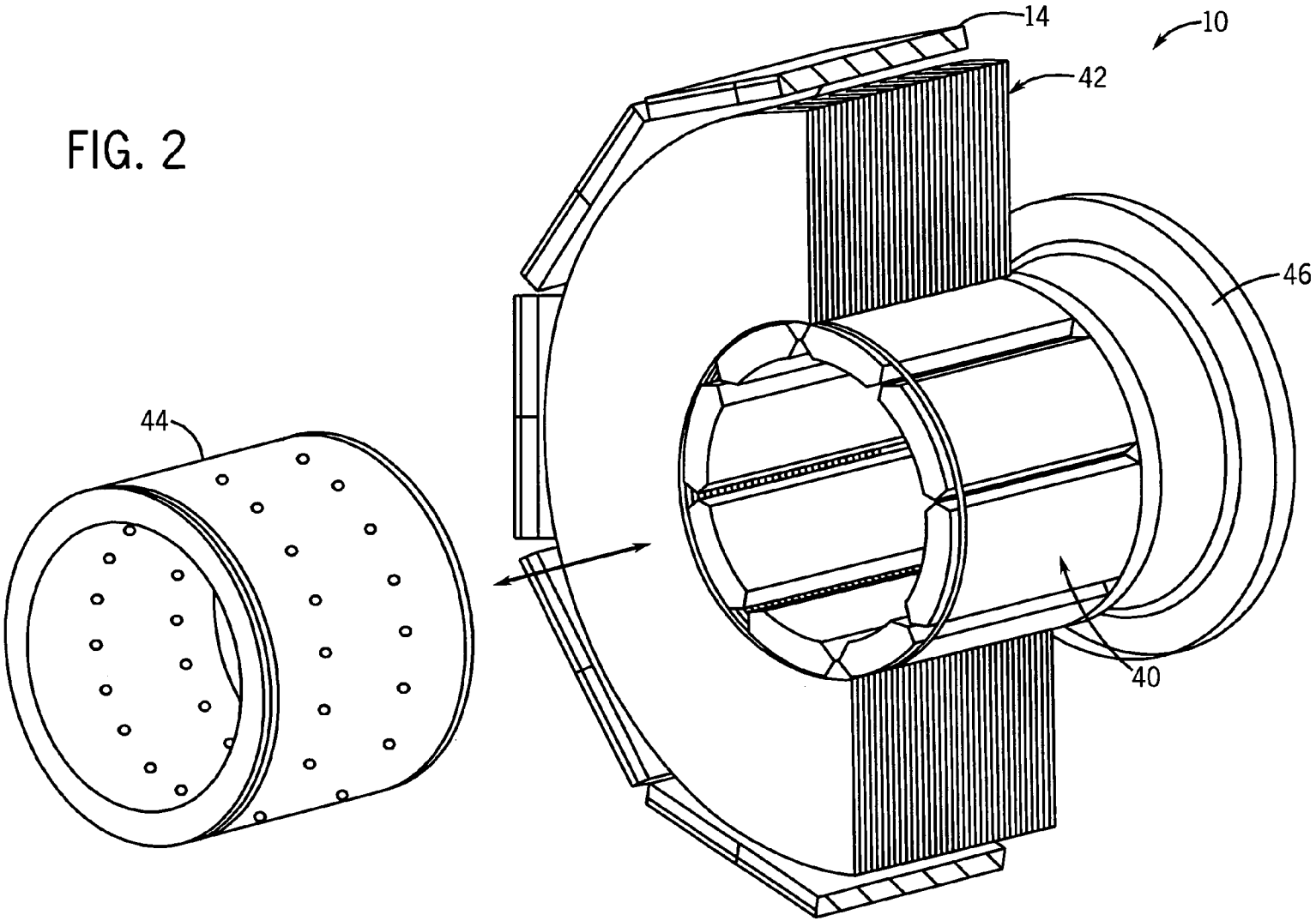
FIG. 2 illustrates a perspective view of swappable slit aperture and pinhole aperture collimators in accordance with embodiments of the present technique.

FIG. 2 illustrates an exemplary SPECT system 10 configured to interchangeably accept a slit aperture collimator 40 with a corresponding septa assembly 42 and a pinhole aperture collimator 44. In the illustrated embodiment, the SPECT system 10 includes a slit aperture collimator 40, a septa assembly 42 and a detector assembly 14. As illustrated, a portion of the detector assembly 14 is removed to illustrate the components of the SPECT system 10, particularly the slit aperture collimator 40 and the septa assembly 42. In one embodiment, the slit aperture collimator 40 may be removeably coupled to a collimator support base 46. The collimator support base 46 may be coupled to a motor (not depicted) to enable rotation of the slit aperture collimator 40. Moreover, the collimator support base 46 may be configured to interchangeably accept the slit aperture collimator 40 and the pinhole aperture collimator 44. Any of a variety of techniques may be used to couple the slit and pinhole aperture collimators 40 and 44 to the collimator support base 46. Further, a septa support assembly (e.g., septa support assembly 81 on FIG. 10) may independently support the septa assembly 42. The septa support assembly may be capable of removing the septa assembly 42 axially from the region of the detector assembly 14 to enable the exchange of slit aperture collimator 40 and the pinhole aperture collimator 44. Alternatively, the septa assembly 42 may be coupled to the slit collimator 40, and thus be capable of co-rotating with it and being removed or inserted with it.

To change performance of the SPECT system 10, it may be desired to exchange the slit aperture collimator 40 for the pinhole aperture collimator 44. For example, the pinhole aperture collimator 44 may be selected for use in the SPECT system 10 for small field of view imaging. In general, exchange of the slit aperture collimator 40 for the pinhole aperture collimator 44 may be based on a number of factors, included the particular imaging application. Accordingly, the slit aperture collimator 40 and septa assembly 42 may be removed from the SPECT system 10. In one embodiment, the slit aperture collimator 40 may be de-coupled from the collimator support base 46 and removed from the SPECT system 10. After removal of the slit aperture collimator 40, the pinhole aperture collimator 44 may be inserted into the SPECT system 10. For example, the pinhole aperture collimator 44 may be coupled to the collimator support base 46.

Figure 3:
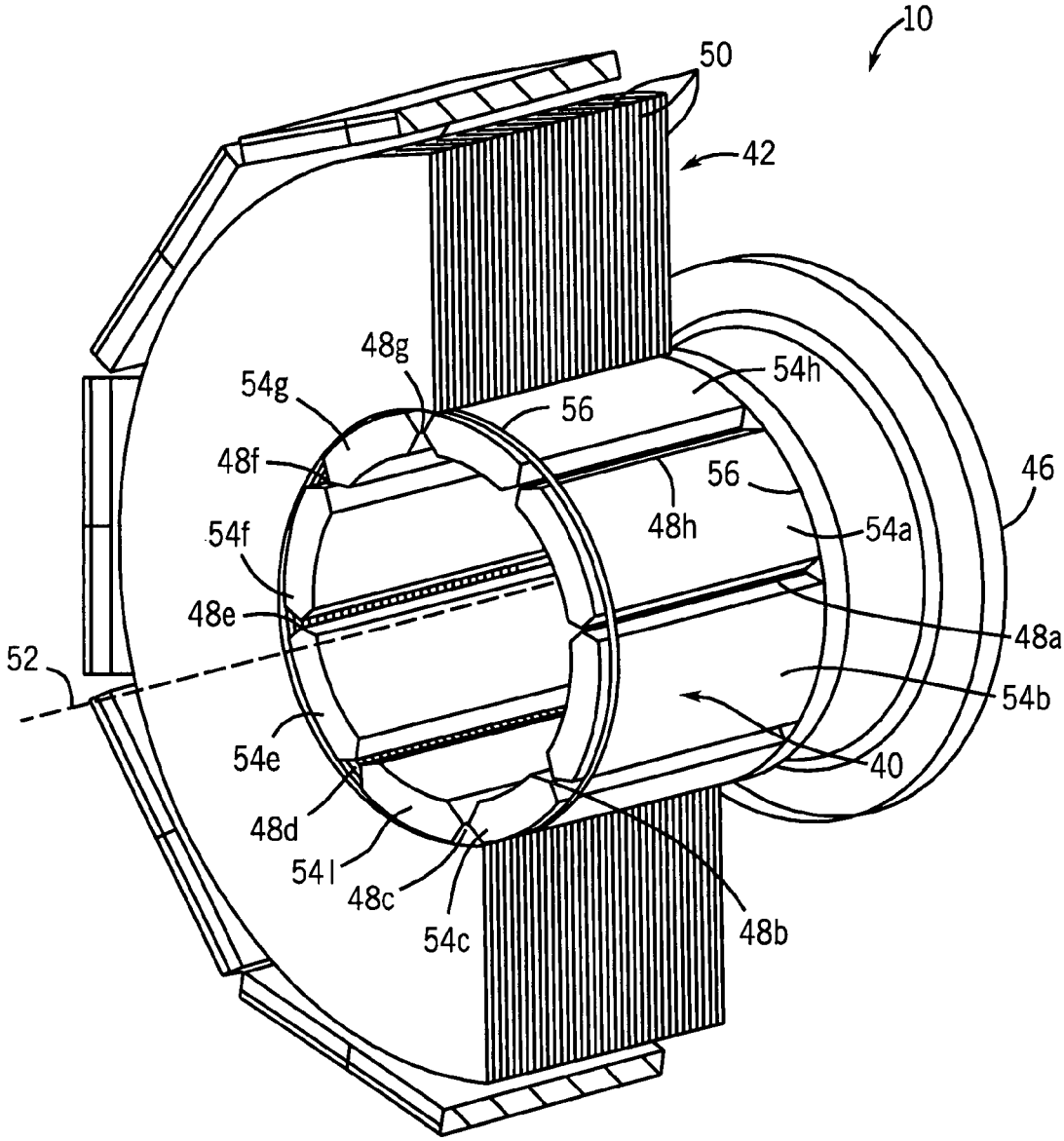
FIG. 3 illustrates a perspective view of an exemplary SPECT system that includes a slit aperture collimator in accordance with embodiments of the present technique.

As previously mentioned, the slit aperture collimator 40 and the pinhole aperture collimator 44 may be exchanged to change the performance of the SPECT system 10. Accordingly, FIGS. 3-6 describe exemplary slit aperture collimators, having corresponding septa assemblies or crossed-slit collimators, and pinhole aperture collimators that may be exchanged in accordance with embodiments of the present technique. Referring now to FIG. 3, a portion of the SPECT system 10 is illustrated, having a slit aperture collimator 40. In the illustrated embodiments, the SPECT system 10 includes a slit aperture collimator 40 having one or more slit apertures 48 (e.g., slit apertures 48*a*-48*h*) therein, a septa assembly 42 having one or more septa 50 spaced on a side of the slit aperture collimator 40 and a detector assembly 14. As illustrated, a portion of the detector assembly 14 is removed to illustrate the components of the SPECT system 10. In exemplary embodiments, the slit aperture collimator 40 may be removeably coupled to the collimator support base 46 to allow exchange of the slit aperture collimator 40 with a pinhole aperture collimator 44. As previously mentioned, it may be desired to exchange the slit aperture collimator 40 and corresponding septa assembly 42 for the pinhole aperture collimator 44 to change the performance of the SPECT system 10. By way of example, the pinhole aperture collimator 44 may be configured to provide a different resolution and/or sensitivity than the slit aperture collimator 40.

In general, the slit aperture collimator 40 and the septa assembly 42 may be arranged such that the one or more slit apertures 48 and the one or more septa 50 define one or more pathways for gamma rays emanating from a subject 28 placed in the field of view 26. Gamma rays aligned with one of the slit/septa pathways should pass through the slit aperture collimator 40 and the septa assembly 42 and impact the detector assembly 14, while gamma rays that are not aligned with one of the slit/septa pathways should not pass therethrough. Those of ordinary skill in the art will appreciate that the slit apertures 48 and the septa 50 generally may define a two-dimensional fan-beam imaging geometry.

In the illustrated embodiment, the slit aperture collimator 40 has one or more slit apertures 48 therein. As illustrated, the slit apertures 48 may extend in a direction generally parallel to the longitudinal axis 52 of the slit aperture collimator 40. In addition, the slit aperture collimator 40 may include one or more sections spaced around the longitudinal axis 52 thereof such that spaces between the sections define the slit apertures 48. By way of example, the spaced sections may be or include one or more panels 54 (e.g., panels 54*a*-54*h*) spaced around the longitudinal axis 52 of the slit aperture collimator 40 to define the slit apertures 48. As illustrated, eight panels 54 are spaced around the longitudinal axis 52 to define eight slit apertures 48. The slit apertures 48 may be referred to as generally one dimensional because the length of the slit apertures 48 is typically long in comparison to their width. For example, the length of the slit apertures 48 may be four, five, ten, or more times greater than their respective width.

For support, the panels 54 may be coupled by a mechanical coupling mechanism, such as bands (rings) 56 illustrated in FIG. 3. By way of example, each of the bands 56 may be coupled to each of the panels 54 at the respective ends of the slit aperture collimator 40. As illustrated, the bands 56 may be configured to hold the panels 54 in a generally cylindrical arrangement. Further, while the panels 54 are illustrated in FIG. 3 as curved sections, the present technique encompasses the use of sections that are not curved. In addition, while the panels 54 of the slit aperture collimator 40 are illustrated as separate sections, the present technique encompasses the use of a slit aperture collimator 40 that is unitary. That is, the slit aperture collimator 40 may be fabricated as a solid piece having one or more slit apertures 48 therein. Furthermore, in certain exemplary embodiments, the slit aperture collimator 40 may be constructed as a unitary piece in which the slit apertures 48 are filled by a material that provides mechanical support but that also allows most gamma rays to pass through the slit apertures 48 without interaction.

As previously mentioned, one or more septa 50 may be spaced on a side of the slit aperture collimator 40 opposite from the field of view 26. In the illustrated embodiment, each of the septa 50 is generally annular-shaped and spaced along the longitudinal axis 52 of the slit aperture collimator 40. The septa 50 may be arranged, for example, to provide the desired slice information for the SPECT system 10. As illustrated, the septa 50 are generally parallel to each other and generally perpendicular to the longitudinal axis 52 of the slit aperture collimator 40. In this embodiment, the septa 50 may define the transaxial slice information for the SPECT system 10 while the slit apertures 48 provide the longitudinal information. Those of ordinary skill in the art will appreciate that the septa may also be arranged in a generally diverging or converging configuration to alter the slice definition by either magnifying or minifying the axial field of view.

In addition, the slit aperture collimator 40 and the septa 50 may each have a thickness sufficient to absorb any gamma rays that do not pass through the slit/septa pathways. By way of example, the slit aperture collimator 40 may have a thickness in the range of from about 10 mm to about 30 mm and the septa 50 may each have a thickness in the range of from about 0.1 mm to about 2 mm. Those of ordinary skill will appreciate that the required thickness to absorb gamma rays depends upon the energy of the gamma rays and the material properties of the slit aperture collimator 40 and the septa 50. Further, the thickness of the slit aperture collimator 40 should provide adequate mechanical strength to support the weight of the collimator and to allow rotation without unpredictable shape distortion.

Those of ordinary skill in the art will appreciate that the resolution and sensitivity of the SPECT system 10 may be based in part on the width of the slit apertures 48 and the spacing of the septa 50. In general, the slit apertures 48 and septa 50 may have the same or different widths, with different widths providing different resolving power. By way of example, the slit apertures 48 and/or the spacing between each of the septa 50 may have two or more different widths. In exemplary embodiments, each of the slit apertures 48 and spacing between septa 50 may have a width in the range of from about 0.1 mm to about 10 mm, typically in the range of from about 1 mm to about 5 mm. The various slit apertures 48 and septa spacing may have a distribution of various sizes, and thus differing spatial resolutions and sensitivities. The image reconstruction algorithm should appropriately model the system response of the various apertures.

Figure 4:
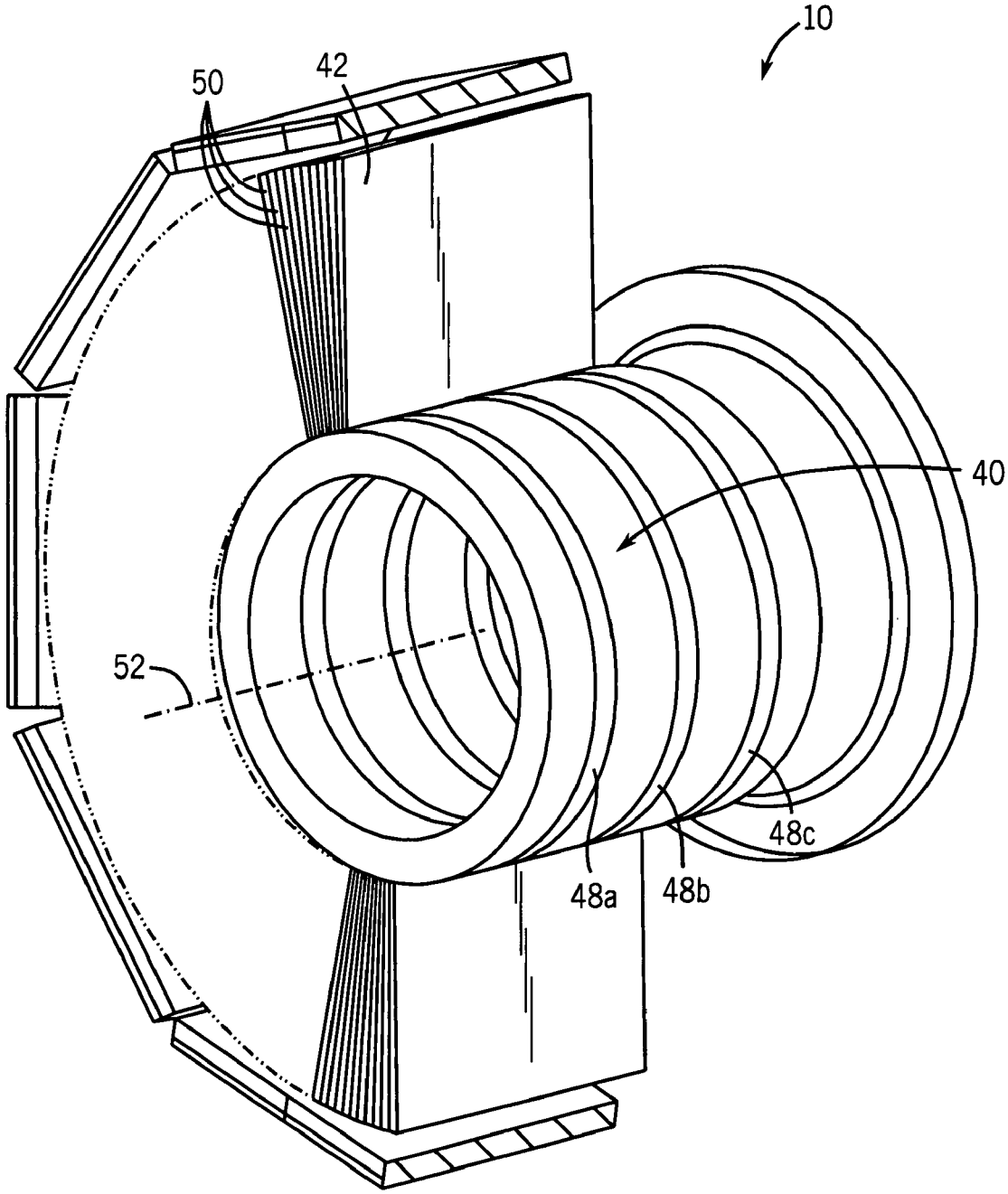
FIG. 4 illustrates a perspective view of an exemplary SPECT system that includes a slit aperture collimator having an alternative slit configuration in accordance with embodiments of the present technique.

While the preceding discussion of FIG. 3 has described the slit apertures 48 in the slit collimator 40 as extending in a direction generally parallel to the longitudinal axis 52 of the slit collimator 40, and the orthogonal septa 50 spaced along the longitudinal axis 52 of the slit aperture collimator 40, one of ordinary skill in the art will recognize that the present technique may be implemented with collimator assemblies having alternative slit configurations. By way of example, as illustrated by FIG. 4, the slit apertures 48 (e.g., slit apertures 48*a*-48*c*) may extend in a direction generally perpendicular to the longitudinal axis 52 of the slit aperture collimator 40 while the septa 50 may extend longitudinally and radially from the slit aperture collimator 40. Alternatively, the slit apertures 48 may extend in a direction generally oblique to the longitudinal axis 52 of the slit aperture collimator 40 and thus describe spirals.

Figure 5:
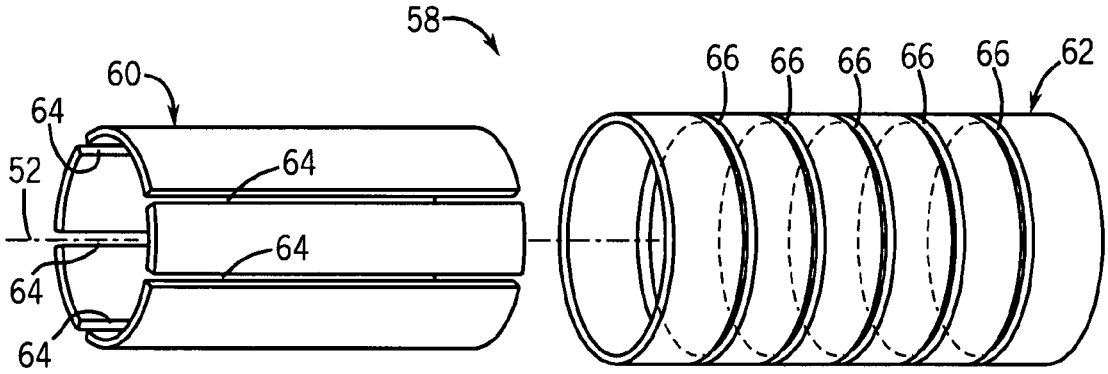
FIG. 5 illustrates a perspective view of an exemplary slit aperture collimator with a corresponding crossed-slit collimator in accordance with embodiments of the present technique.

Those of ordinary skill in the art will appreciate that the septa assembly 42 may be replaced by a crossed-slit collimator as illustrated in FIG. 5. By way of example, an inner slit aperture collimator 60 is shown with inner slit apertures 64 generally parallel to the longitudinal axis 52. An outer slit collimator (or crossed-slit collimator) 62 is shown with outer slit apertures 66 generally perpendicular to the longitudinal axis 52. As will be discussed in more detail below, the inner and outer slit aperture collimators 60 and 62 should be configured such that the inner slit apertures 64 and the outer slit apertures 66 define one or more apertures therethrough. In exemplary embodiments, the slit direction in the inner slit collimator 60 may be chosen to be perpendicular to the longitudinal axis 52 and the slit direction in the outer slit collimator 62 may be chosen to be generally parallel to the longitudinal axis 52. Further, in exemplary embodiments, the slit directions may be chosen to be oblique to the longitudinal axis 52 and thus describe spirals with the inner and outer slit apertures 64 and 66 in the inner and outer slit aperture collimators 60 and 62 generally orthogonal to each other. Moreover, in exemplary embodiments, the inner and outer slit apertures 64 and 66 may be oblique to each other.

Figure 6:
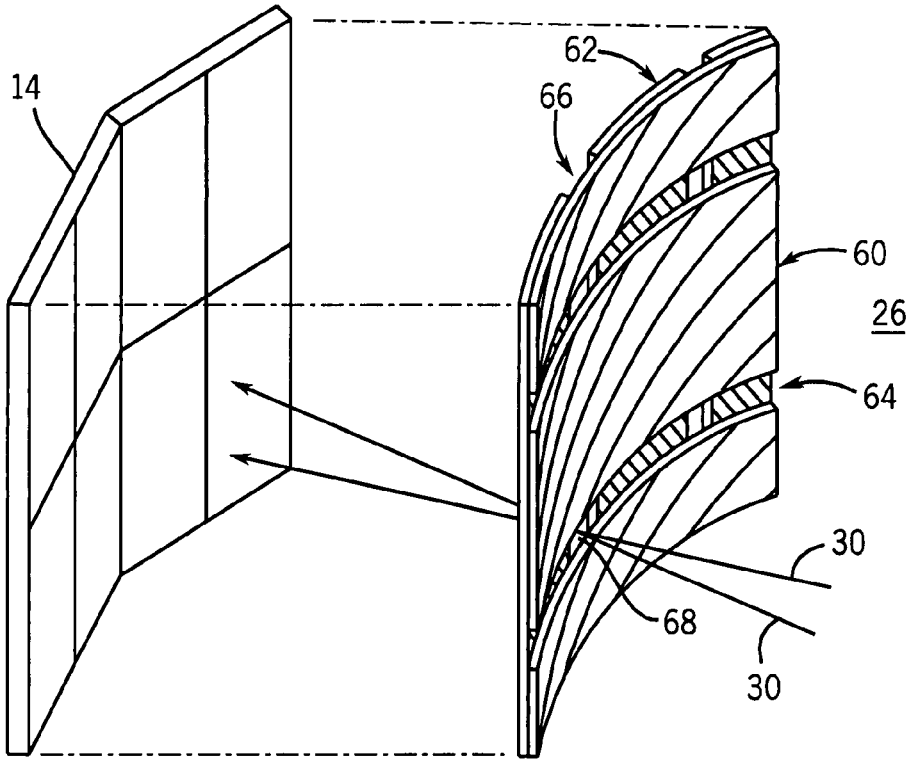
FIG. 6 illustrates a perspective view of a portion of an exemplary slit aperture collimator with a corresponding crossed-slit collimator in accordance with embodiments of the present technique.

Referring now to FIG. 6, a portion of the detector assembly 14, the inner slit aperture collimator 60 and the outer slit aperture collimator 62 are shown to illustrate the apertures defined by the alignment of the inner and outer slit apertures 64 and 66, in accordance with an embodiment of the present technique. As previously mentioned, the inner and outer slit aperture collimators 60 and 62 should be configured such that the inner slit apertures 64 and the outer slit apertures 66 define one or more apertures 68 therethrough. Gamma rays 30 that do not pass through the one or more apertures 68 should be absorbed by the inner and outer slit aperture collimators 60 and 62. In the illustrated embodiment, the apertures 68 are defined by the intersection of the inner slit apertures 64 and the outer slit apertures 66. The apertures 68 allow gamma rays 30 emanating from the field of view 26 to pass through the inner and outer slit aperture collimators 60 and 62 and impact the detector assembly 14.

Figure 7:
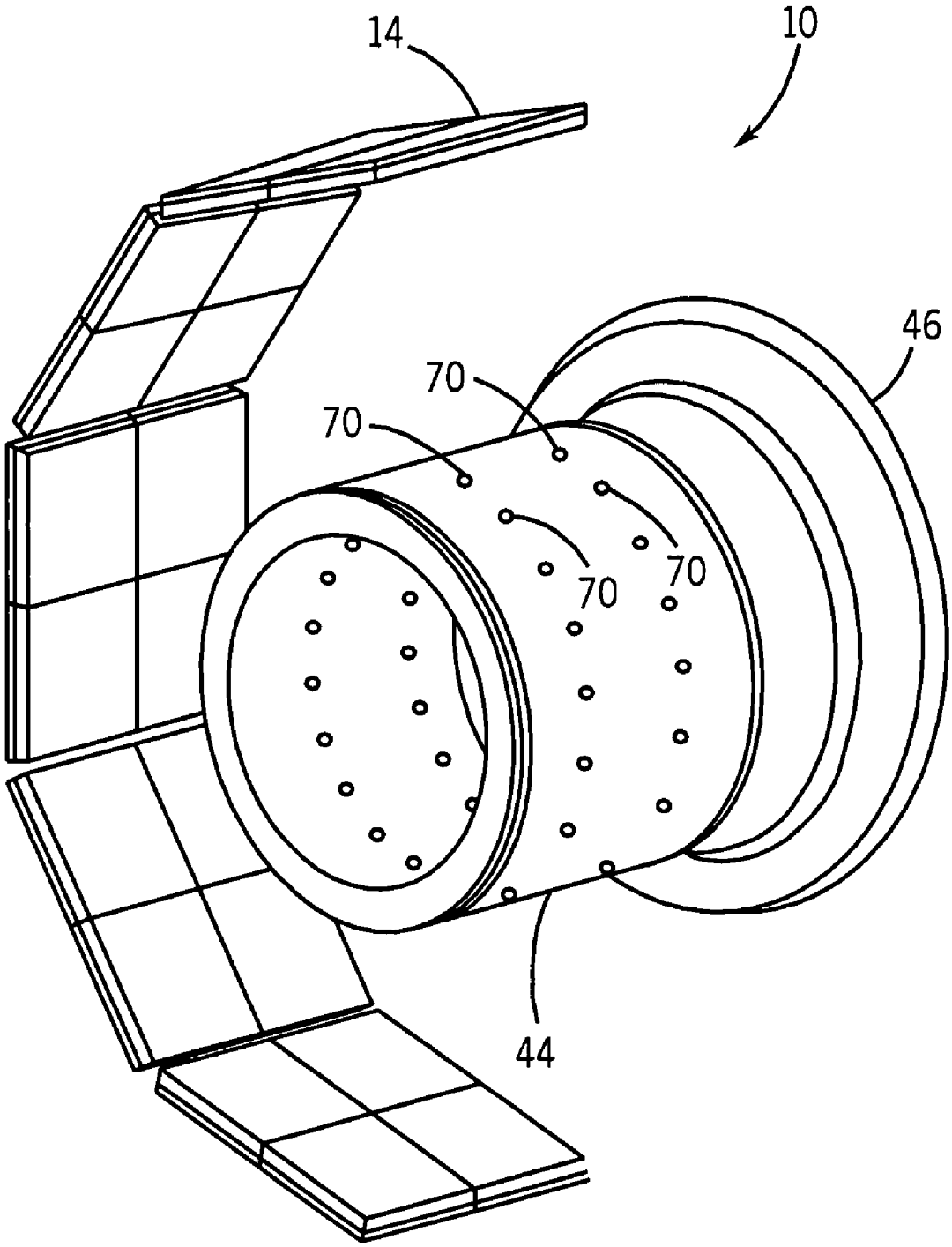
FIG. 7 illustrates a perspective view of an exemplary SPECT system that includes a pinhole aperture collimator in accordance with embodiments of the present technique.

Referring now to FIG. 7, a pinhole aperture collimator 44 having one or more pinhole apertures 70 is illustrated, in accordance with embodiments of the present technique. In the illustrated embodiment, a detector assembly 14 encircles the pinhole aperture collimator 44. As illustrated, a portion of the detector assembly 14 is removed to illustrate the pinhole aperture collimator 44. In exemplary embodiments, the pinhole aperture collimator 44 may be removeably coupled to the collimator support base 46 to allow exchange of the pinhole aperture collimator 44 with a slit aperture collimator 40. As previously mentioned, it may be desired to exchange the pinhole aperture collimator 44 for the slit aperture collimator 40 with corresponding septa assembly 42 or corresponding crossed-slit collimator (such as outer slit aperture collimator 62 on FIG. 5) to change the performance of the SPECT system 10. By way of example, the slit aperture collimator 40 may be configured to provide a different resolution and/or sensitivity than the pinhole aperture collimator 44.

In general, gamma rays aligned with one of the pinhole apertures 70 should pass through the pinhole aperture collimator 44, while gamma rays that are not aligned with one of the pinhole apertures 70 should be absorbed by the pinhole aperture collimator 44. Accordingly, the pinhole aperture collimator 44 should have a thickness sufficient to absorb any gamma rays that do not pass through the pinhole apertures 70. By way of example, the pinhole aperture collimator 44 may have a thickness in the range of from about 10 mm to about 30 mm. Those of ordinary skill will appreciate that the required thickness to absorb gamma rays depends upon the energy of the gamma rays and the material properties of the pinhole aperture collimator 44. Further, the thickness of the pinhole aperture collimator 44 should provide adequate mechanical strength to support the weight of the pinhole aperture collimator 44 and to allow rotation without unpredictable shape distortion. In certain exemplary embodiments, the pinhole apertures 70 may be filled with a material that allows most gamma rays to pass through the pinhole apertures 70 without interaction.

In the illustrated embodiment, the pinhole apertures 70 in the pinhole aperture collimator 44 are arranged in two rows. The pinhole apertures 70, however, may be arranged in the pinhole aperture collimator 44 in a variety of different configurations. In exemplary embodiments, the pinhole apertures 70 may be arranged in the pinhole aperture collimator 44 in one, two, three, or more rows or in other ordered or pseudo-random patterns. Those of ordinary skill in the art will appreciate that the pinhole apertures 70 generally define a three-dimensional cone-beam imaging geometry. While the pinhole apertures 70 are illustrated as having a generally circular configuration, those of ordinary skill in the art will appreciate that the pinhole apertures 70 may have any suitable geometry. By way of example, the pinhole apertures 70 may be configured as having aperture configurations that are substantially polygonal (e.g., three-sided, four-sided, five-sided, six-sided, and so forth), or substantially curved (e.g., elliptical, circular, and so forth).

Those of ordinary skill in the art will appreciate that the resolution and sensitivity of the SPECT system 10 is based in part on the cross-sectional area of the pinhole apertures 70. In general, the pinhole apertures 70 may have the same or different cross-sectional areas. By way of example, the pinhole apertures 70 may have two or more different cross-sectional areas. In exemplary embodiments, each of the pinhole apertures 70 may have a width in the range of from about 0.1 mm to about 10 mm, typically in the range of from about 1 mm to about 5 mm. The various pinhole apertures 70 may have a distribution of various sizes, and thus differing spatial resolutions and sensitivities. The image reconstruction algorithm should appropriately model the system response of the various apertures.

While the slit aperture collimator 40 and pinhole aperture collimator 44 are illustrated herein as being generally cylindrically shaped, the present technique encompasses the employment of collimator assemblies that are not generally cylindrically shaped. By way of example, the slit aperture collimator 40 (or pinhole aperture collimator 44) may be or include a flat panel having one or more slit apertures 48 (or pinhole apertures 70) therein. Furthermore, one of ordinary skill in the art will recognize that the collimators and detectors may be combined in modules and positioned to view portions of the field of view. If only a few collimator/detector modules are deployed, then they may be moved to a plurality of positions during image acquisition in order to acquire sufficient data for tomographic image reconstruction. Alternatively, if sufficient collimator/detector modules are deployed, then they may remain stationary during image acquisition and yet acquire sufficient data for tomographic image reconstruction.

Furthermore, those of ordinary skill in the art will appreciate that the efficiency of gamma ray detection is based on the number of apertures, such as slit apertures 48 in FIGS. 3, 4, and 5 and pinhole apertures 70 in FIG. 7. By way of example, a collimator assembly configured to have a large number of slit or pinhole apertures 48 and 58 would typically require less or no rotation to obtain a sufficient number of angular projections for image reconstruction. Accordingly, the number of the slit or pinhole apertures 48 and 58 may be adjusted to provide the desired imaging sensitivity for a desired imaging time. Those of ordinary skill in the art will appreciate that the number and spacing of the slit and pinhole apertures 48 and 58 should be chosen with consideration of the efficient utilization of the detector assembly 14 and the performance of the image reconstruction and processing module 18. For example, limited overlap of gamma ray lines of response impacting on the detector assembly 14 may be acceptable.

Figure 8:
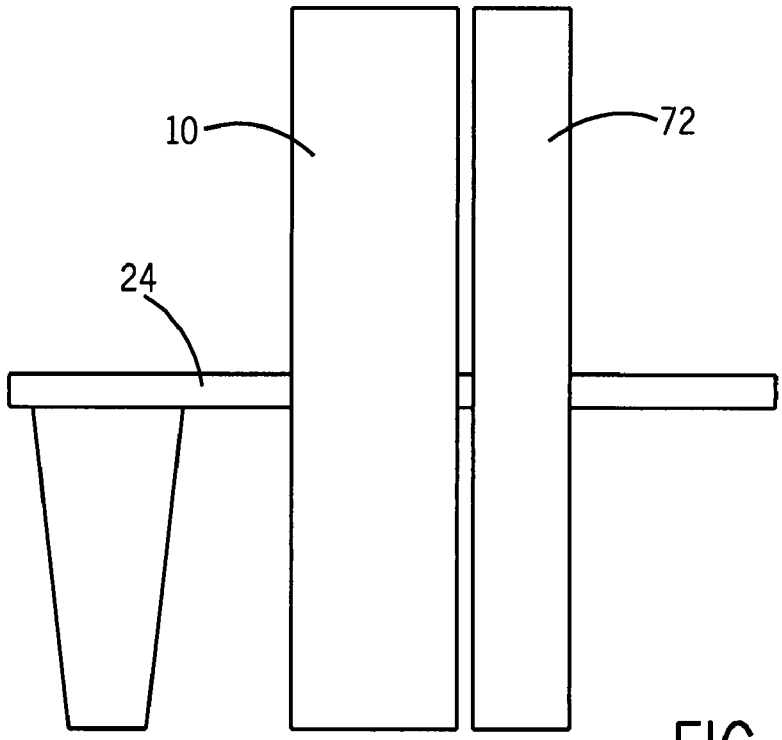
FIG. 8 illustrates a side view of an exemplary combined SPECT and computed tomography (CT) system in accordance with embodiments of the present technique.
Figure 9:
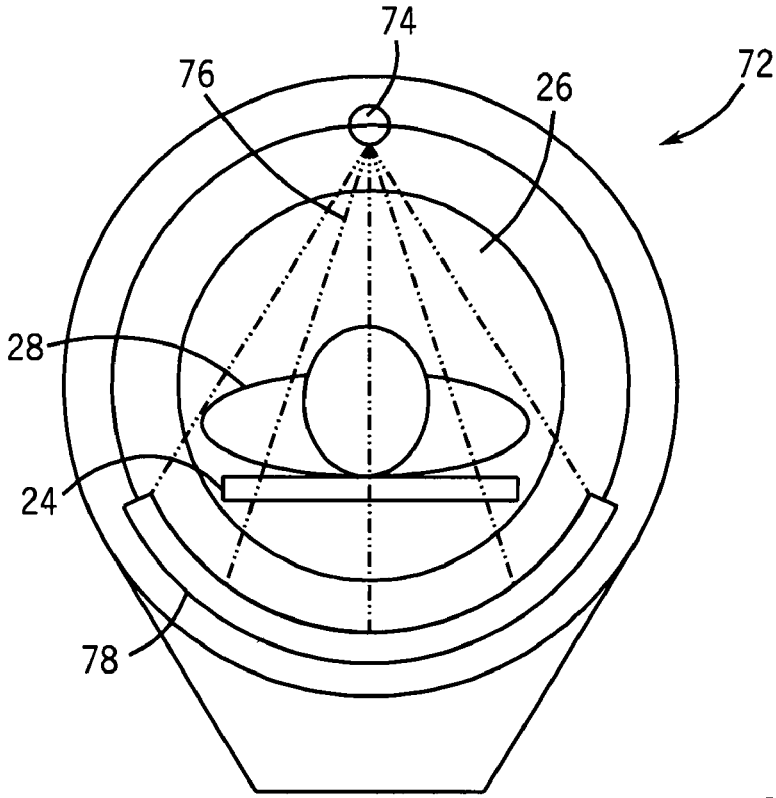
FIG. 9 illustrates an end view of an exemplary CT system that can be combined with a SPECT system in accordance with embodiments of the present technique.

While specific reference in the present discussion is made to a SPECT system, it should be appreciated that the present technique is not intended to be limited to this or any other specific type of imaging system or modality. Rather, exemplary embodiments of the present technique may be used in conjunction with other imaging modalities, e.g., coded-aperture astronomy. In addition, SPECT system 10 may be combined with a second imaging system, such as a CT system or a magnetic resonance imaging (MRI) system. By way of example, the SPECT system 10 may be combined in the same gantry with a CT system. As illustrated in FIG. 8, a SPECT/CT imaging system includes SPECT system 10 and CT system 72. By way of example, the SPECT system 10 and the CT system 72 are shown as separate modules, aligned along a common longitudinal axis, and sharing a single subject support 24. As illustrated by FIG. 9, CT system 72 includes a source 74 of X-ray radiation configured to emit a stream of radiation 76 in the direction of the field of view 26 and an X-ray detector assembly 78 configured to generate one or more signals in response to the stream of radiation. Those of ordinary skill in the art will appreciate that in the third-generation CT configuration illustrated in FIG. 9, the source 74 and the X-ray detector assembly 78 generally rotate in synchrony around the field of view 26 while acquiring a plurality of lines of response passing through the subject 28, so that an X-ray tomographic attenuation image may be reconstructed. Other CT configurations may be employed, including the shared use of at least a portion of the SPECT detector assembly 14 as the X-ray detector assembly 78. Further, the SPECT and CT images may be acquired sequentially, in any order, by repositioning the subject, or concurrently by sharing the detector array. The images generated with the CT system 72 may then be used to generate gamma ray attenuation maps, for example, to calculate attenuation and/or scatter correction during the SPECT image reconstruction. In addition, the CT anatomical images may be combined with the SPECT functional images.

Figure 10:
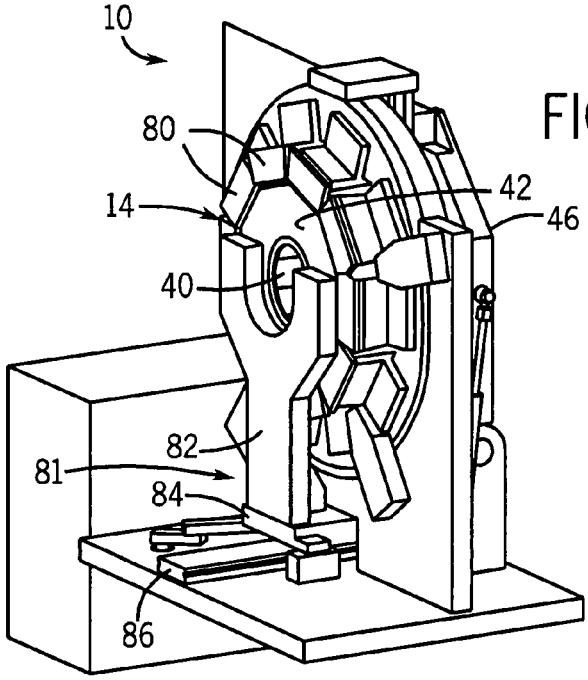
FIGS. 10-14 illustrate an exemplary method for removing a slit aperture collimator and corresponding septa assembly from a SPECT system in accordance with embodiments of the present technique.
Figure 11:
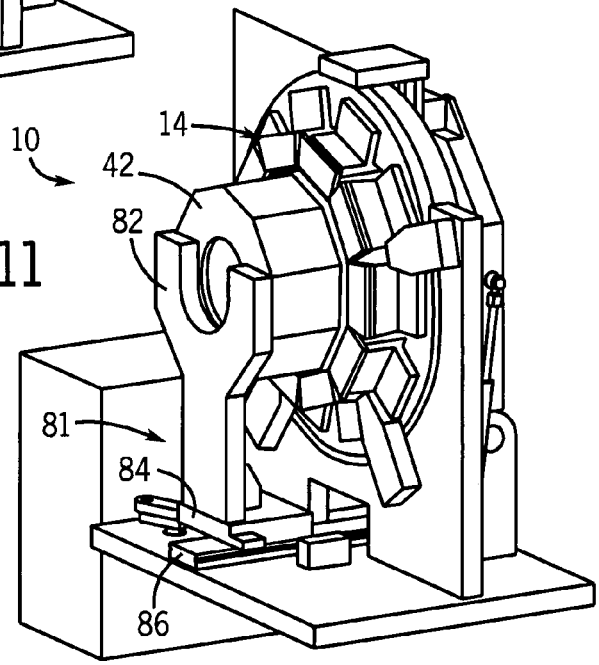

FIGS. 10-14 illustrate an exemplary method for removing a septa assembly 42 and a slit aperture collimator 40 from a SPECT system 10 in accordance with one embodiment of the present technique. Referring now to FIG. 10, a SPECT system 10 is illustrated having a detector assembly 14, a slit aperture collimator 40 and a septa assembly 42. As illustrated, the detector assembly 14 may include detector modules 80. The septa assembly 42 may be coupled to a septa support assembly 81. In exemplary embodiments, the septa support assembly 81 may be configured for removal of the septa assembly 42 from the SPECT system 10. In the illustrated embodiment, the septa support assembly 81 includes a septa support arm 82, a septa support table 84 and a rail 86. As illustrated, one end of the septa assembly 42 may be coupled to the septa support arm 82. The bottom of the septa support arm 82 may be coupled to the septa support table 84. The septa support table 84 may be coupled to the rail 86. In exemplary embodiments, the septa support table 84 may be slidably coupled to the rail 86.

Referring now to FIG. 1, the septa assembly 42 may be removed from the SPECT system 10 in accordance with one embodiment of the present technique. In the illustrated embodiment, the septa assembly 42 may be removed axially from the region of the SPECT system 10 surrounded by the detector assembly 14. As illustrated, the septa support table 84 may be configured to slide on the rail 86 in the axial direction to enable removal of the septa assembly 42. Removal of the septa assembly 42 may enable the subsequent removal of the slit aperture collimator 40 from the SPECT system 10.

Figure 12:
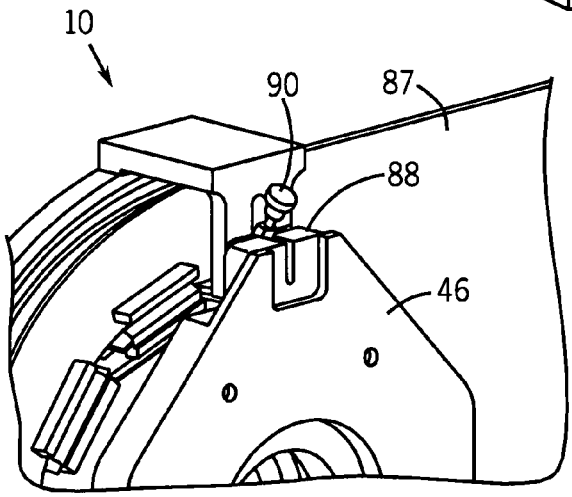
Figure 13:
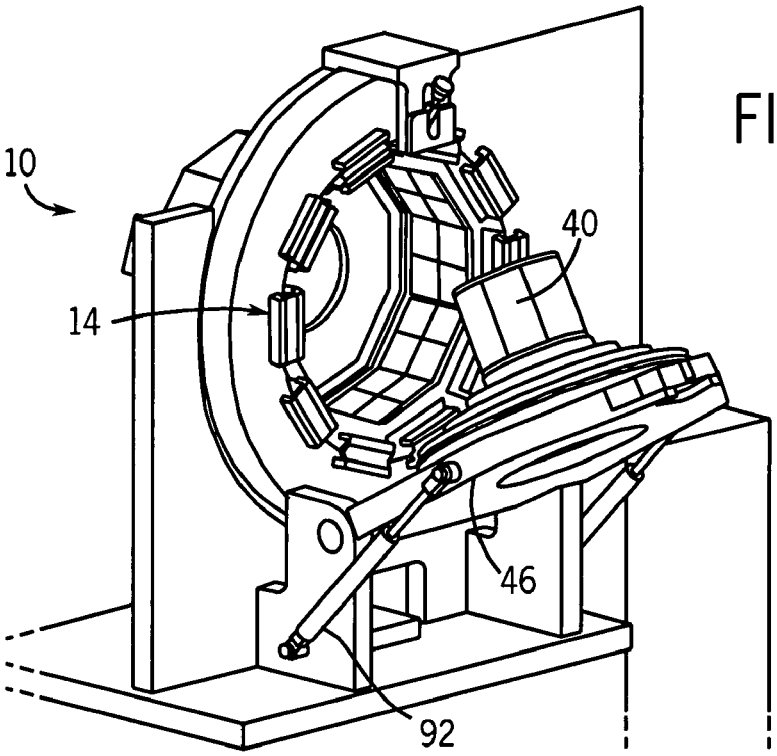
Figure 14:
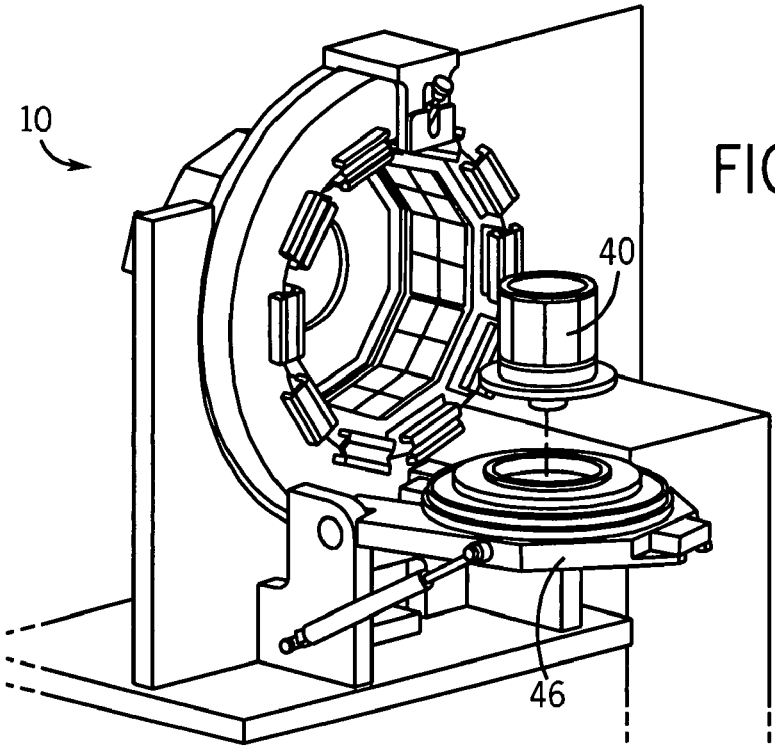

Referring now to FIG. 12, the collimator support base 46 may be de-coupled from the frame 87 of the SPECT system 10 in accordance with one embodiment of the present technique. As illustrated, the collimator support base 46 may be coupled to the frame 87 of the SPECT system 10. Any of a variety of suitable mechanisms may be used to couple the collimator support base 46 to the frame 87. In the illustrated embodiment, the collimator support base 46 may include latch 88 into which the latch pin 90 may be inserted. To unlatch the collimator support base 46, the latch pin 90 may be removed from the latch 88 of the collimator support base 46, for example. Once the collimator support base 46 has been unlatched, the collimator support base 46 may be lowered, as illustrated by FIG. 13, to facilitate removal of the slit aperture collimator 40, in accordance with one embodiment of the present technique. As illustrated, lowering the collimator support base 46 may involve rotating the collimator support base 46 about an axis. In one exemplary embodiment, the collimator support base 46 may be coupled to a pair of shock-absorbing arms 92 to, for example, control the lowering of the collimator support base 46. Alternatively, in one exemplary embodiment, the collimator support base 46 may be configured to be moved axially from the region of the SPECT system 10 surrounded by the detector assembly 14. As illustrated by FIG. 14, the slit aperture collimator may be decoupled from the collimator support base 46 and removed from the SPECT system 10. In accordance with embodiments of the present technique, a pinhole aperture collimator (such as pinhole aperture collimator 44 on FIG. 7) may then be inserted into the SPECT system 10.

Those of ordinary skill in the art will appreciate that FIGS. 10-14 and the accompanying description describe one suitable method for the removal of a slit aperture collimator 40 from the SPECT system 10. Any of a variety of other suitable methods for the removal of collimators from the SPECT system 10 is encompassed by the present technique.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method of adjusting performance of an imaging system, comprising:

removing a slit aperture collimator from the imaging system, the imaging system comprising the slit aperture collimator, at least one of a crossed-slit collimator disposed circumferentially about the slit aperture collimator or a septa assembly having one or more septa spaced circumferentially about the slit aperture collimator, and a detector assembly configured to detect collimated gamma rays emanating from a subject in a field of view of the imaging system, wherein the slit aperture collimator is coupled to a collimator support base disposed on a side of the detector assembly, wherein the collimator support base is coupled to a motor to enable rotation of the slit aperture collimator, and wherein the collimator support base is adapted to be moved axially from a region of the imaging system surrounded by the detector assembly;

removing either the crossed-slit collimator or the septa assembly from the imaging system; and inserting a pinhole aperture collimator into the imaging system.

2. The method of claim 1, wherein the imaging system comprises a single photon emission computed tomography system or a combined single photon emission computed tomography/x-ray computed tomography system.

3. The method of claim 1, wherein the slit aperture collimator and the pinhole aperture collimator each comprise a radiation absorbent material.

4. The method of claim 1, wherein the imaging system comprises the septa assembly, wherein removing the septa assembly from the imaging system comprises moving the septa assembly in an axial direction.

5. The method of claim 1, wherein removing the slit aperture collimator from the imaging system comprises rotating a collimator support base about an axis, wherein the slit aperture collimator is coupled to the collimator support base.

6. The method of claim 1, wherein the imaging system comprises the crossed-slit collimator, wherein the crossed-slit collimator comprises one or more slit apertures therein, wherein the one or more slit apertures in the crossed-slit collimator are generally orthogonal to one or more slit apertures in the slit aperture collimator.

7. A method of adjusting performance of an imaging system, comprising:

removing a pinhole aperture collimator from the imaging system, the imaging system comprising the pinhole aperture collimator and a detector assembly configured to detect collimated gamma rays emanating from a subject in a field of view of the imaging system;

inserting a slit aperture collimator into the imaging system, wherein the slit aperture collimator is coupled to a collimator support base disposed on a side of the detector assembly, wherein the collimator support base is coupled to a motor to enable rotation of the slit aperture collimator, and wherein the collimator support base is adapted to be moved axially from a region of the imaging system surrounded by the detector assembly; and inserting either a septa assembly or a cross-slit collimator into the imaging system, wherein the septa assembly or the cross-slit collimator is disposed circumferentially about the slit aperture collimator.

8. The method of claim 7, wherein the imaging system comprises a single photon emission computed tomography system or a combined single photon emission computed tomography/x-ray computed tomography system.

9. The method of claim 7, wherein the pinhole aperture collimator and the slit aperture collimator each comprise a radiation absorbent material.

10. The method of claim 7 wherein the crossed-slit collimator is inserted into the collimator assembly, wherein the crossed-slit collimator comprises one or more slit apertures therein, wherein the one or more slit apertures in the crossed-slit collimator are generally orthogonal to one or more slit apertures in the slit aperture collimator.

11. An imaging system, comprising:

a detector assembly configured to detect collimated gamma rays emanating from a subject in a field of view of the imaging system and generate one or more signals in response to the detected gamma rays;

a collimator support base disposed on one side of the detector assembly and configured to interchangeably accept a slit aperture collimator and a pinhole aperture collimator in place of one another; and a septa support assembly disposed on an opposite side of the detector assembly and configured to hold the septa assembly for use with the slit aperture collimator in a position between the field of view of the imaging system and the detector assembly and configured to remove the corresponding septa assembly from the position between the field of view and the detector assembly when the pinhole aperture collimator is mounted to the collimator support base.

12. The imaging system of claim 11, wherein the imaging system comprises a single photon emission computed tomography system or a combined single photon emission computed tomography/x-ray computed tomography system.

13. The imaging system of claim 11, wherein the slit aperture collimator comprises one or more slit apertures that extend in a direction generally parallel, perpendicular, or oblique to a longitudinal axis of the slit aperture collimator.

14. The imaging system of claim 11, wherein the slit aperture collimator comprises one or more slit apertures that are generally orthogonal to the one or more septa of the corresponding septa assembly.

15. The imaging system of claim 11, wherein the slit aperture collimator comprises one or more slit apertures that are generally orthogonal to one or more slit apertures of the corresponding crossed-slit collimator.

16. The imaging system of claim 11, wherein the detector assembly comprises at least one of an array of solid-state detector elements or a scintillator assembly coupled to light sensors.

17. The imaging system of claim 11, comprising:

a module configured to receive the one or more signals and to process the one or more signals to generate one or more images; and an image display workstation configured to display the one or more images.

18. The imaging system of claim 11, comprising a support for supporting a subject in the field of view.

19. The imaging system of claim 11, wherein the septa support assembly comprises a septa support arm coupled to the corresponding septa assembly, and a rail, wherein the setpa support arm is slidably coupled to the rail.

20. The imaging system of claim 11, wherein the collimator support base is configured to rotate about an axis for removal of the interchangeable first and second collimators.

21. The imaging system of claim 11, wherein the collimator support base comprises a latch for coupling the collimator support base to a frame of the imaging system.

* * * * *